US005458538A

United States Patent [19]

MacLeod et al.

[11] Patent Number: 5,458,538

[45] Date of Patent: Oct. 17, 1995

[54] ROOF VENT

[75] Inventors: Richard J. MacLeod, Milford; Charles E. Schiedegger, Metamora; Jack G. Wnuk, Lapeer; Clyde G. Allen, North Branch, all of Mich.

[73] Assignee: Mid-America Building Products Corporation, Plymouth, Mich.

[21] Appl. No.: 373,532

[22] Filed: Jan. 17, 1995

Related U.S. Application Data

[63] Continuation of Ser. No. 10,609, Jan. 28, 1993, abandoned.

[51] Int. Cl.[6] ..... F24F 7/02

[52] U.S. Cl. ..... 454/365; 52/57; 52/199

[58] Field of Search ..... 52/57, 199; 454/365

[56] References Cited

U.S. PATENT DOCUMENTS

| | | | |
|---|---|---|---|
| 2,579,662 | 12/1951 | Gibson | 454/365 |
| 4,676,147 | 6/1987 | Mankowski | 454/365 |
| 4,924,761 | 5/1990 | MacLeod et al. | 454/365 |
| 5,009,149 | 4/1991 | MacLeod et al. | 454/365 |
| 5,052,286 | 10/1991 | Tubbesing et al. | 454/365 |
| 5,095,810 | 3/1992 | Robinson | 454/365 |
| 5,122,095 | 6/1992 | Wolfert | 454/365 |
| 5,149,301 | 9/1992 | Gates | 454/365 |
| 5,174,076 | 12/1992 | Schiedegger et al. | 454/365 X |

*Primary Examiner*—Harold Joyce

*Attorney, Agent, or Firm*—Barnes, Kisselle, Raisch, Choate, Whittemore & Hulbert

[57] ABSTRACT

A roof vent comprising a one-piece plastic body including a base wall with air guiding vanes to ventilate the interior of a building. A plurality of spaced intermediate transverse supports are provided along the central longitudinal axis of the plastic body. The intermediate supports are adapted to facilitate folding at the center of the vent to maintain a straight line bend and to provide support for the central portion of the vent to improve stiffness and appearance. The supports overlap to accommodate different roof angles. Additionally, the roof vent has a tongue and groove arrangement on the end walls at each end for an interlocking connection to an adjacent roof vent. One embodiment of the roof vent is adapted for use on a hip roof. In this embodiment, a separate wall is used to deflect entry of snow or rain. The supports have notches to accommodate the separate wall. Furthermore, drain openings are provided in the vanes and the end walls to allow moisture to escape and cross-walls are also provided to prevent moisture from flowing along the inside surface of the roof vent.

10 Claims, 5 Drawing Sheets

ROOF VENT

This is a continuation of application Ser. No. 08/010,609, filed on Jan. 28, 1993, abandoned.

This invention relates to roof vents.

BACKGROUND AND SUMMARY OF THE INVENTION

It has heretofore been known that it is desirable to provide roof vents for ventilating a roof.

Prior roof vents have been known. For example, U.S. Pat. No. 4,924,761 discloses a roof vent comprising a one-piece plastic body having a base wall with transversely spaced rows of integral vanes extending from one surface. The vanes of adjacent rows define a sinuous path through which air is vented when the vent is positioned with the vanes engaging the roof and the base wall spaced from the roof. The vanes also prevent water and snow from entering beneath the vent.

The roof vent of U.S. Pat. No. 5,009,149 discloses a similar roof vent constructed to further inhibit water or snow from entering underneath the roof vent. The vanes of the inner row have a longer length than the vanes of the outer row and are provided with an axially extending straight portions having a curved portion to further deflect moisture.

A roof vent for a hip roof is disclosed in assigned U.S. Pat. No. 5,174,076, issued Dec. 29, 1992, having a common assignee with the present application. A separate wall with a longitudinally extending portion is provided with a roof vent where the wall lies between the ends of the vanes of the roof vent and the roof and the longitudinally extending portion extends toward the base wall of the roof vent. This separate wall prevents snow and water from entering laterally underneath the roof vent.

One problem sometimes encountered with prior roof vents is that the roof vent is subject to bowing or collapsing due to warpage, or under the weight of snow or ice buildup or upon impact of nailing during installation or upon workmen stepping thereon.

Another problem with prior roof vents is that separate roof vents are designed one to be used only on a ridge roof and another only on a hip roof.

Yet another problem with prior roof vents, and particularly with hip roof vents, is that rain and snow may be blown in laterally underneath the roof vent. Additionally, inadequate drainage may trap any moisture which happens to collect underneath the roof vent.

Among the objectives of the present invention are to provide an improved roof vent which will effectively vent the interior of a building; which will preclude entry of water and blowing snow and insects by the action of wind from entering the building; which will prevent insects and the like from entering the building; which can be readily adapted to roofs of varying slopes and inclinations; which will prevent ice buildup thereon; which will prevent collapse or bowing of the vent due to warpage or snow buildup, impact or other weight thereon; which is pleasing in appearance; which is low in cost; and which can be readily handled in the field; and which can be utilized for arrangement of roofs which are unsymmetrical.

In accordance with the invention, a roof vent comprises an integral one-piece plastic body including a base wall with air guiding vanes to ventilate the interior of a building. A plurality of spaced intermediate supports are provided along the central longitudinal axis of the plastic body. The intermediate supports are adapted to facilitate folding at the center of the vent and maintain a straight line bend and to provide support for the central portion of the vent. Thus, the vent is prevented from bowing or collapsing due to the weight from snow buildup or due to the impact of nailing the vent to the roof. Additionally, the supports overlap for use with roofs having different angles.

The roof vent is also provided with an interlocking connection for attachment to adjacent roof vents.

The present invention also provides a roof vent adapted for use both on a ridge roof and a hip roof thus eliminating the need for separate roof vents. In hip roof applications, a separate baffle is used to block blowing snow and rain.

The present invention further provides adequate drainage, particularly for use on a hip roof to prevent moisture from being trapped underneath the roof vent.

DESCRIPTION

Figure 1:
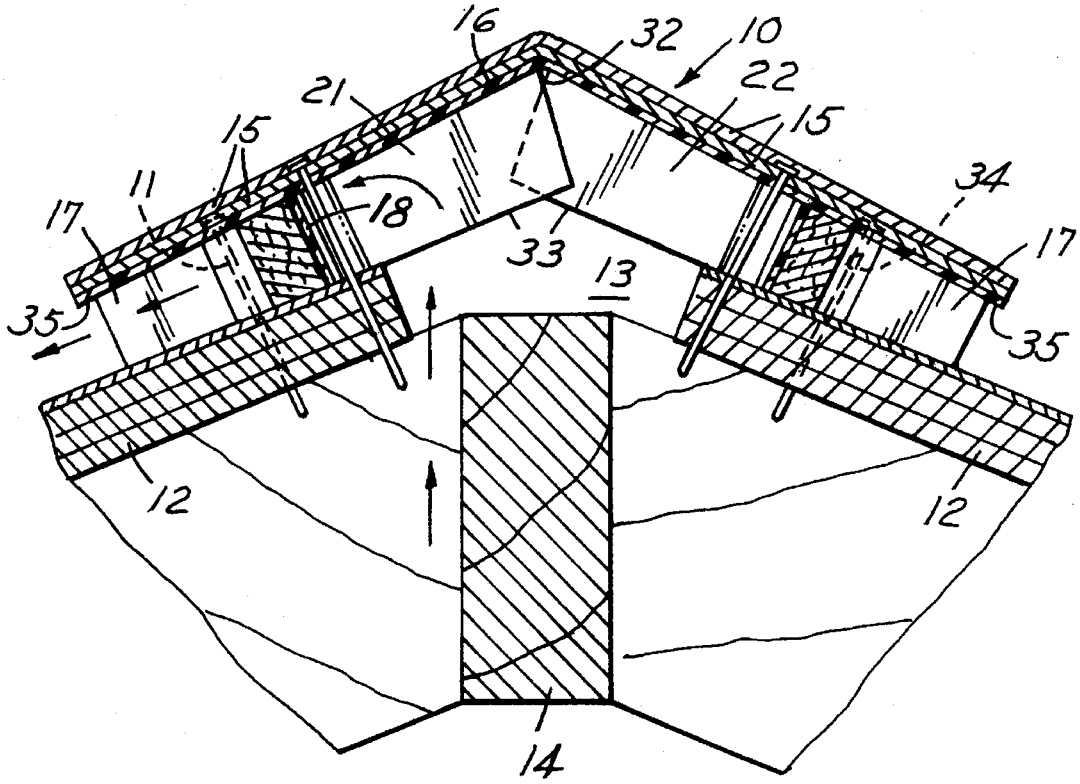
FIG. 1 is a transverse section through a roof of a building utilizing the roof vent embodying the invention taken along line H in FIG. 2.
Figure 8:
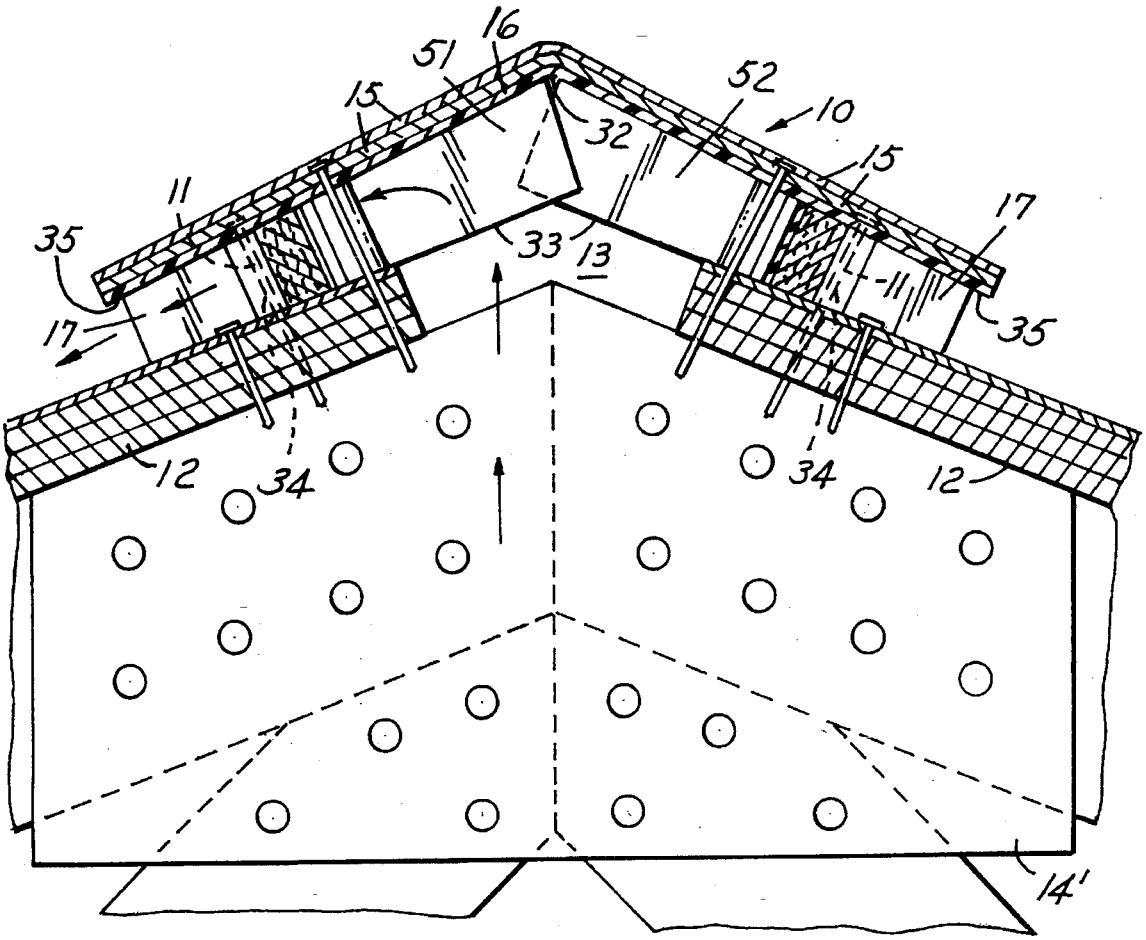
FIG. 8 is a transverse section similar to FIG. 1 showing the adaptation of the roof vent with a truss roof.

Referring to FIGS. 1 and 8, the roof vent 10 embodying the invention is adapted to be mounted on the ridge of a roof by nails 11 extending into the roof in order that the interior of the building may be vented. In accordance with well known construction, portions of the roof walls 12 are cut away as at 13 adjacent either a ridge board 14 or a truss 14' and the vent 10 is positioned over the shingles on the roof walls 12 and over the opening 13. Subsequently, sections of roofing or shingle material 15 are provided over the vent in overlapping relation, if desired over the roof vent.

Figure 3:
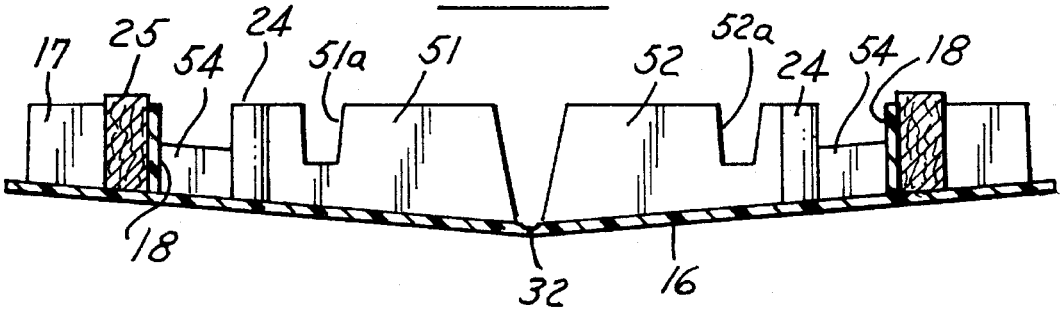
FIG. 3 is a sectional view taken along line 3—3 in FIG. 2.
Figure 4:
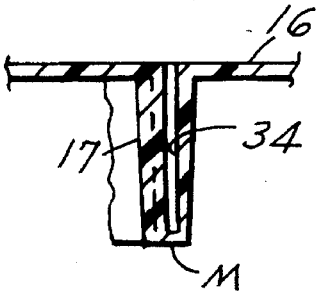
FIG. 4 is a sectional view taken along line 4—4 in FIG. 2.
Figure 2:
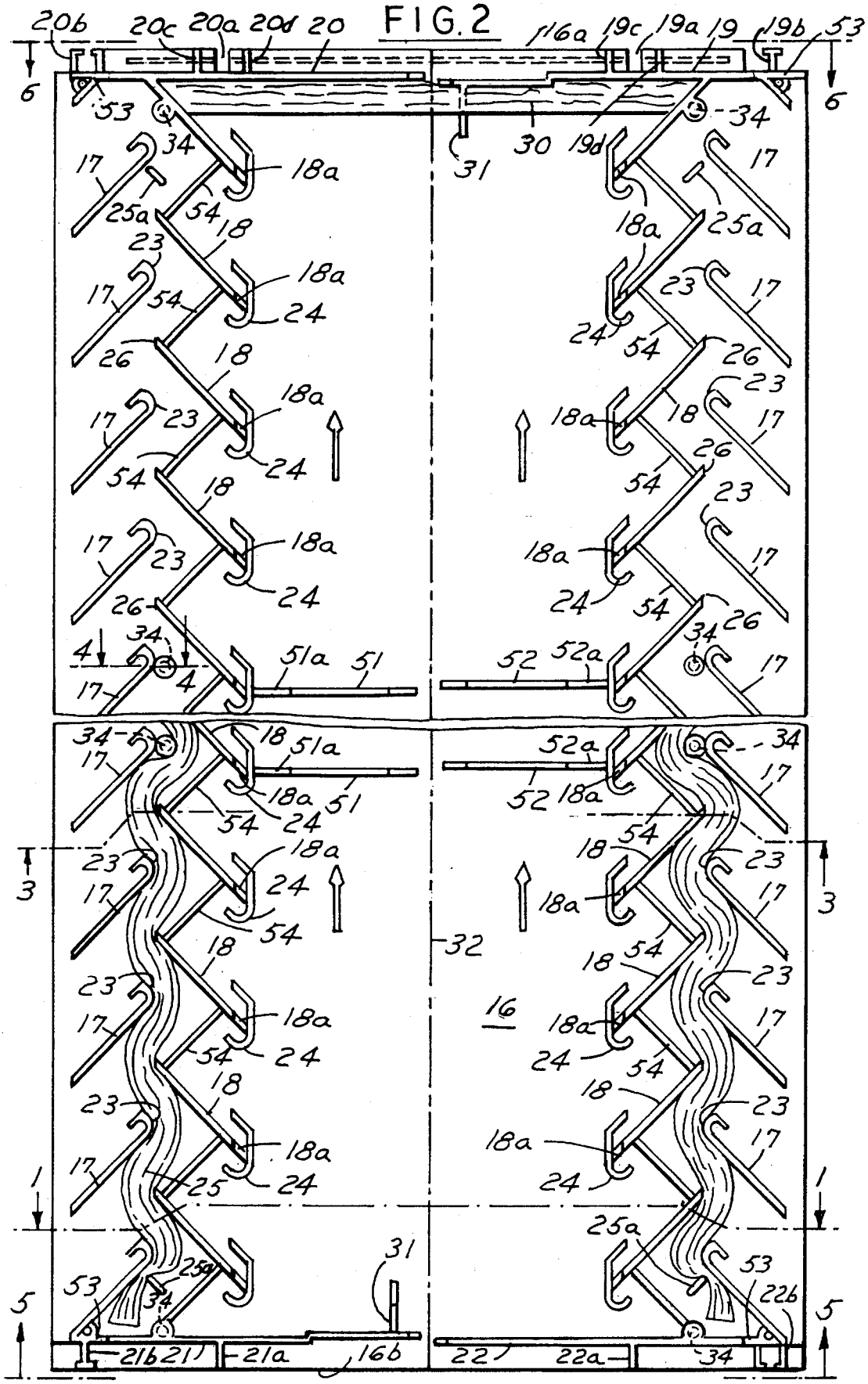
FIG. 2 is a fragmentary bottom plan view of the roof vent before it is bent to conform to the roof.
Figure 5:
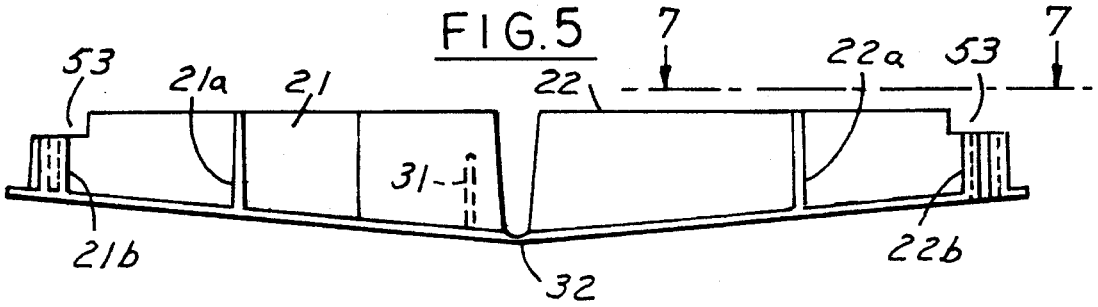
FIG. 5 is an end view of the roof vent taken along line 5—5 in FIG. 2.
Figure 6:
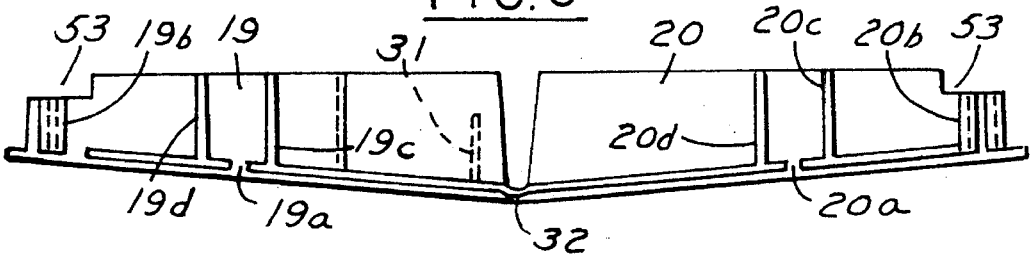
FIG. 6 is an end view of the roof vent taken along line 6—6 in FIG. 2.

In accordance with the invention, as seen in FIGS. 2 and 3, the roof vent 10 comprises an integral one-piece plastic body which is molded preferably by injection molding and includes a base wall 16. The roof vent further comprises means for guiding air from the inside of a building to the exterior thereof, such as, for example, air guiding vanes 17, 18. The air guiding vanes 17, 18 can be of the type which comprise a plurality of rows of vanes extending generally perpendicular from the base wall 16. In addition, the roof vent includes end walls 19, 20, 21, 22 (FIG. 2) that are molded integrally with the base wall 16 and extend outwardly in relatively longitudinally spaced relation. The end walls 19–22 have free edges that engage the roof 12. Each set of the vanes 17, 18 is provided in two rows along the longitudinal edges of the base wall 16, the vanes being identical except that the row of vanes 17 in the outermost row are in longitudinally spaced parallel relation and the vanes 18 in the innermost row are in longitudinally spaced relation such that the plane of the vanes 17 intersects the plane of the vanes 18. In addition, each of the vanes 17 is provided with a curved end 23 as are the vanes 18 provided with a curved end 24. The curved ends 23, 24 function to entrap water and snow that may be blown inwardly by the wind. Thus, air is vented through a sinuous path outwardly when the vent is positioned with the vanes engaging the roof in the base wall spaced from the roof.

Further, a layer 25 of foraminous material such as open cell foam plastic is interposed between the adjacent ends 23, 24 of the vanes 17, 18 and functions to prevent insects and blowing snow from entering the' building while permitting air to exit from under the roof. Preferably, the layers 25 are held in position by ribs 25*a* that extend from the inner surface of the base wall 16.

Similarly, a layer 30 of non-porous plastic material is provided adjacent each end of the end walls 19–22 and is held in position by projections 31 that extend from the surface of the wall to prevent the entry of insects as well as air and moisture through the end walls.

The base wall 16 is formed with a portion 32 that extends longitudinally and has a thinner cross section so that the user can bend the wall to the desired angle for conforming the roof vent to the angle of the roof members 12. After such conformation, the nails 11 can be driven through elongated openings 34 to mount the vent in position on the roof. A membrane M of thinner cross section closes the elongated opening 34 such that only a portion of the elongated opening will be pierced by the nail 11 thus minimizing any chance of moisture or rain from entering through the openings that are formed by the piercing. Thus, the pleasing appearance of the roof vent is facilitated.

The edges 35 (FIG. 1) of the wall extend over vanes 17 such as to form an overhang. When the base wall 16 is bent along the thin portion 32, the end walls 19–22 are caused to overlap one another to close and form a continuous wall.

The above construction is substantially similar to that shown in U.S. Pat. Nos. 4,924,761 and 5,009,149, incorporated herein by reference.

In accordance with the invention, a plurality of spaced intermediate support walls 51, 52 are provided along each side of the central longitudinal thin portion 32 of the vent body. The support walls 51, 52 are integral with and extend from the underside of the base wall 16 with one support wall 51 being provided on one side of the thin portion 32 substantially adjacent the other support wall 52. The spaced support walls 51, 52 are arranged and constructed to overlap when the base wall is bent to accommodate roofs of varying angles.

The support walls 51 are located along a first longitudinal row along the length of the base wall 16 with an inner end adjacent the thin portion 32 and an outer end integral with curved end 24 of vane 18. A second longitudinal row of similarly constructed support walls 52 is provided along the length of the base wall 16 adjacent the thin portion 32 on the opposite side thereof. The support walls 51, 52 maybe spaced, for example, between six to twelve inches apart for every four foot section of the roof vent. The support walls 51, 52 in the first and second rows are closely adjacent each other at the inner ends thereof and overlap when the roof vent is bent and applied to a roof. This construction allows for application to roofs with different pitches. The support walls 51, 52 also have free ends 33 that engage the roof 12 at the outer ends thereof but which are spaced from either the ridge board 14 or truss 14' when the vent is positioned on the roof.

The support walls 51, 52 facilitate folding along the thin portion 32 and assist in maintaining a straight line bend. As seen particularly in FIGS. 1 and 8, the middle portion of the roof vent is unsupported from underneath. However, the support walls 51, 52 provide support and strength at the middle along the thin portion 32 to ensure that the roof vent bends clearly about the thin portion 32. The support walls 51, 52 also provide strength to support the weight of snow or ice buildup and to give strength to resist impact due to nailing during installation.

Each end of the roof vent has an integral first and second portions 16*a*, 16*b*. The first end portion 16*a* is adapted to extend underneath the second end portion 16*b* of an adjacent roof vent when connected together. Extending outwardly from each end wall and integral with the base wall are first and second interlocking means. The first interlocking means 19*b*, 21*b* are T-shaped extensions located adjacent opposite edges of said roof vent. The second interlocking means 20*b*, 22*b* have a complementary groove therein and are located opposite the first interlocking means 19*b*, 21*b*.

Located substantially centrally of the plastic body are first and second interengaging means. The first interengaging means 19*a*, 20*a* is a slot in the first end portion 16*a* and is adapted to receive second interengaging means 21*a*, 22*a* on an adjacent roof vent. This arrangement of the first and second interlocking means and the first and second interengaging means provide for a secure connection between adjacent roof vents and prevents water, snow and insects from entering at the intersection of two roof vent sections.

Figure 10:
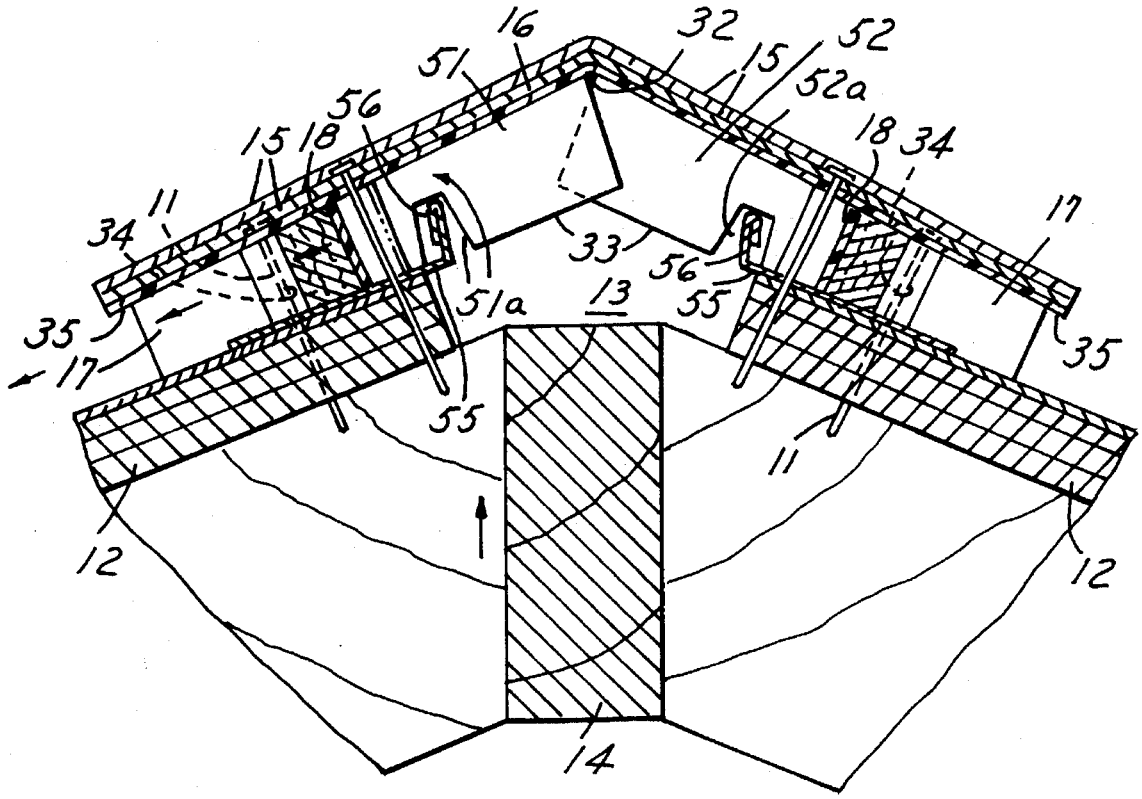
FIG. 10 is a transverse section of the roof vent of FIG. 2 shown on a hip roof.

The roof vent is also adapted to be used on a hip roof as seen in FIG. 10. Hip roofs present a peculiar problem in that water or snow may be blown laterally underneath the roof vent. To prevent this from happening, a separate wall 55 is provided over the free ends of vanes 17, 18 and lies between the free ends and the roof. The wall 55 has an integral longitudinally extending portion 56 to deflect entry of snow or rain as disclosed and described in U.S. patent application Ser. No. 07/786,558, filed Nov. 1, 1991, now U.S. Pat. No. 5,174,076 incorporated herein by reference. The support walls 51, 52 have notches 51*a*, 52*a* to provide clearance for the longitudinally extending portion 56.

Figure 7:
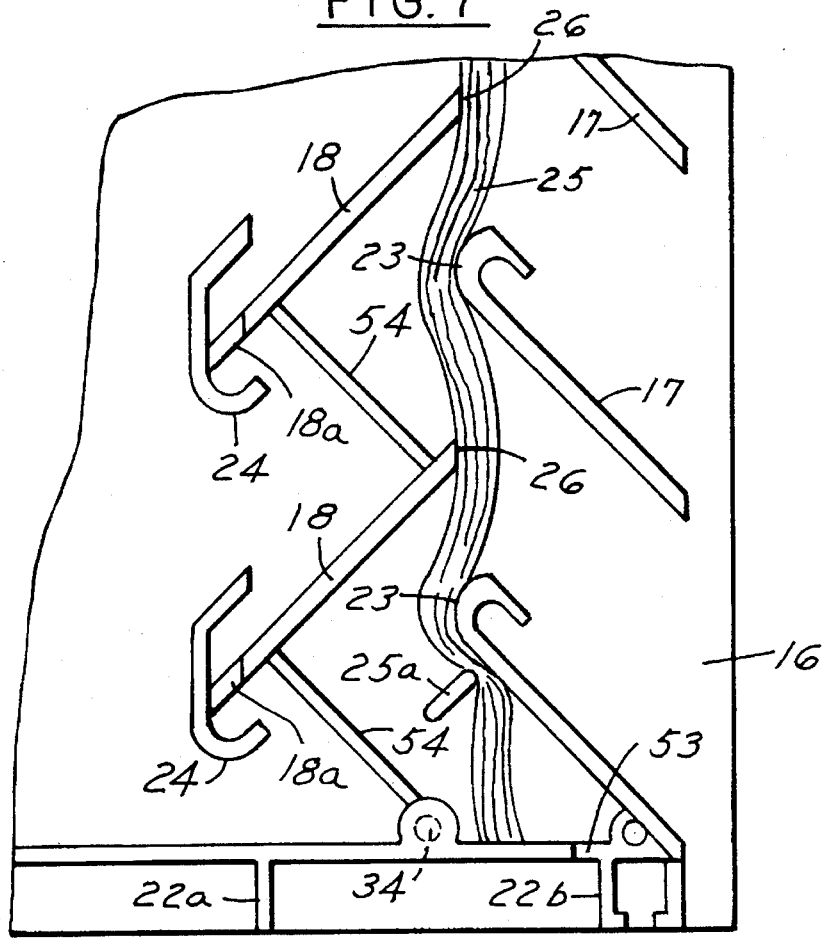
FIG. 7 is a partial bottom plan view taken along line 7—7 in FIG. 5.

To provide for drainage particularly when used on a hip roof, each end wall 19–22 is provided with drainage openings 53. Additionally, vanes 18 have drain openings 18*a* (FIG. 7) to drain melted ice, snow and rain allowing the moisture to flow through the vanes 18. The drain openings 18*a* are preferably adjacent the juncture of the vane 18 and curved end 24. Between each vane 18 are located integral cross-walls 54 positioned substantially parallel with vanes 17. The cross-walls have a shorter length than the vanes 17, 18 (FIG. 3) and prevent moisture, for example, condensation from flowing along the inside surface of the base wall.

Figure 9:
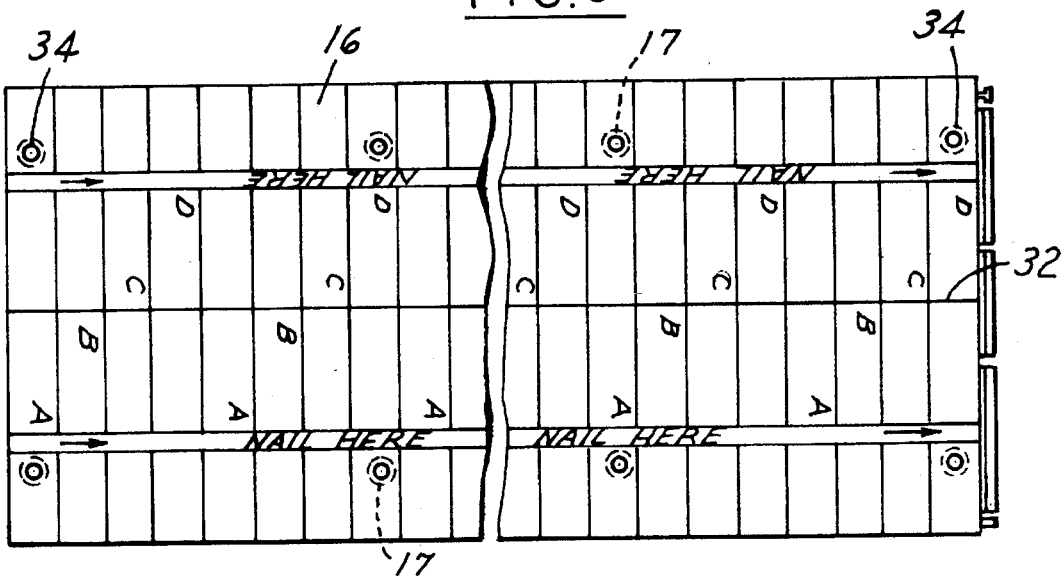
FIG. 9 is a fragmentary top plan view of the roof vent of the present invention.

Preferably, as shown in FIG. 9 arrows A provide an indication of direction of placement of the roof vent during installation. Indicia I are provided to indicate areas permissible to nail through. Further indicia I' provide an alignment guide when shingles 15 (FIGS. 1 and 8) are nailed to the roof vent.

It can thus be seen that there has been provided a roof vent which will effectively vent the interior of a building; which will preclude entry of water and blowing snow and insects, by the action of wind from entering the building; which will prevent collapse or bowing due to snow buildup or impact; which can be readily adapted to roofs of varying slopes and inclinations; which is adapted for connection to adjacent roof vents; which is adapted to be used on either a ridge roof or a hip roof; which provides adequate drainage, which is pleasing in appearance; which is low in cost; and which can be readily handled in the field; and which can be utilized for arrangement of roofs that are unsymmetrical.

We claim:

1. A roof vent comprising a one-piece plastic body including a longitudinally extending base wall having ends, said plastic body having a thin portion extending along a central longitudinal axis of the plastic body, means for guiding air from underneat the plastic body to the exterior thereof comprising rows of integral vanes on the underside of said base walls, end walls integral with said base wall at each end of said base wall, each said end wall having a free edge adapted to engage the roof, said base wall having a first end portion and a second end portion at the opposite end thereof wherein the second end portion is adapted to overlap a first end portion of an adjacent roof vent when the roof vent is bent along said thin portion, a plurality of first longitudinal row of spaced intermediate support walls spaced from the end walls along the length of the base wall adjacent one side of said thin portion having inner and outer ends and a free edge, a plurality of second longitudinal row of spaced intermediate support walls spaced from the end walls along the length of the base wall adjacent said thin portion adjacent the opposite side thereof having inner and outer ends and a free edge, the inner ends of said spaced intermediate support walls in said first longitudinal row being closely adjacent the inner ends of said spaced intermediate support walls in said second longitudinal row, the free edges of said spaced support walls being adapted to engage a roof at the outer ends thereof, each said intermediate support wall being integral with said base wall and integral with a vane.

2. The roof vent set forth in claim 1 wherein said closely adjacent intermediate support walls have inner ends which overlap at the inner ends thereof when the roof is bent along the thin portion and applied to a roof.

3. The roof vent set forth in claim 2 wherein said base wall has first interlocking means at one end and second interlocking means at the other end wherein the first interlocking means is adapted to engage a second interlocking means of an adjacent roof vent.

4. The roof vent set forth in claim 3 wherein said first interlocking means comprises a tongue and said second interlocking means has a complementary groove adapted to receive a tongue on an adjacent roof vent, said first and second interlocking means located adjacent each edge of said roof vent.

5. The roof vent set forth in claim 4 wherein said tongue adjacent each edge of said roof vent is T-shaped, said base wall further comprising first interengaging and second interengaging means comprising integral longitudinal walls extending from said end walls at a right angle to the end walls located substantially centrally of each said end wall of said plastic body such that said first interengaging means is adapted to engage a second interengaging means on an adjacent roof vent.

6. The roof vent set forth in claim 1 wherein each said end wall has a drainage opening at its outermost end in said free edge.

7. The roof vent as set forth in claim 1 wherein said means for guiding air comprises inner and outer rows of vanes integral with said base wall and having free edges for engaging a roof, and each said vane in said inner row has a drainage opening on the free edge at an inner end thereof.

8. The roof vent set forth in claim 7 wherein said vanes in said inner row have a curved end and said drainage opening is located adjacent the curved end.

9. A roof vent set forth in claim 7 comprising cross-walls extending between the vanes in each inner row to prevent moisture from flowing along an inside surface of said base wall.

10. The roof vent set forth in any one of claim 7 including a separate wall provided over the free edges of the vanes and including a longitudinally extending portion that extends from the separate wall toward the base wall and located adjacent the inner ends of the vanes wherein the longitudinally extending portion terminates in spaced relation to the base wall such that when the vent is applied to a hip roof and is subjected to transverse winds, water and snow will be deflected from entry into the building.

* * * * *